US005203559A

United States Patent [19]

Goldfarb

[11] Patent Number: 5,203,559

[45] Date of Patent: Apr. 20, 1993

[54] BOWLING APPARATUS HAVING SPRING DRIVEN WIND-UP STRIKER

[76] Inventor: Adolph E. Goldfarb, 1432 S. Eastwind Cir., Westlake Village, Calif. 91361

[21] Appl. No.: 832,733

[22] Filed: Feb. 7, 1992

[51] Int. Cl.[5] ..... A63D 3/00

[52] U.S. Cl. ..... 273/37; 273/41; 273/85 R; 273/108; 446/4; 446/465; 446/464

[58] Field of Search ..... 273/85 R, 85 F, 108, 273/127 R, 127 A, 128 R, 128 A, 129 M, 127 S, 37, 38, 41; 446/4, 158, 457, 458, 464, 465

[56] References Cited

U.S. PATENT DOCUMENTS

| | | | |
|---|---|---|---|
| 2,749,126 | 6/1956 | Schneider | 273/108 |
| 4,113,255 | 9/1978 | Goldfarb et al. | 273/108 |
| 4,568,308 | 2/1986 | Itoh | 446/464 |
| 4,832,650 | 5/1989 | Tong | 446/158 X |
| 4,938,481 | 7/1990 | Goldfarb et al. | 446/465 X |
| 5,103,936 | 4/1992 | Morikawa | 446/464 X |

FOREIGN PATENT DOCUMENTS

| | | | |
|---|---|---|---|
| 1157490 | 11/1983 | Canada | 273/38 |

*Primary Examiner*—V. Millin
*Assistant Examiner*—William M. Pierce
*Attorney, Agent, or Firm*—Ashen & Lippman

[57] ABSTRACT

Game apparatus comprising of at least one self-standing upright playpiece and a self-powered striker self-movable along a supporting surface so as to engage and knock over the playpiece. The striker may be aimed toward the playpiece from a stationary position and then caused to move forwardly in the aimed direction toward the playpiece. This allows even young children to take their time to aim the playpiece and not have to try to aim or direct it while it is already moving forwardly. There may be a plurality of the playpieces, each shaped as a fish or other character. The illustrated striker is in the form of a shark having a side-to-side oscillating tail. The striker may engage and knock over the playpieces with its nose, and also with its oscillating tail as it goes by the playpieces.

6 Claims, 4 Drawing Sheets

BOWLING APPARATUS HAVING SPRING DRIVEN WIND-UP STRIKER

BACKGROUND OF INVENTION

There have been a variety of prior bowling game apparatus. Typically a plurality of upright standing pieces are arranged in a supporting surface and a projectile is rolled or thrown to try to knock over the pieces. Various strikers have been used in such games.

To Applicant's knowledge, none of the prior art striker devices provide the same or a similar combination of elements, nor the resulting action and play value as provided by Applicant's bowling game apparatus. In particular, Applicant's illustrated shark striker is spring-wound by the child-user pulling it downwardly along a support surface. The child can then hold the striker in a stationary fixed position from where he or she can aim it toward the fish playpieces. The child then releases the striker which thereby causes it to move forwardly toward the playpieces. The illustrated striker mechanism includes an initial high-torque low-speed mode followed by a lower-torque high-speed mode. This allows the striker to get going from the stationary position and then have enough speed when it engages the playpieces to readily knock them over. Further, the illustrated striker has a pivoted tail section which oscillates back and forth as the striker moves forwardly. Thus, not only are playpieces struck and knocked over by the front end (jaws) of the striker, but by the oscillating tail as the striker moves past the playpieces. If a particular striker has a tendency to veer one way or the other, particularly as a result of the side-to-side tail action, an adjustment means may be provided on the striker for counter-acting that tendency to veer to one side.

This combination of oscillating tail action and multiple speed forward movement provides a highly entertaining and high-play value toy, particularly for younger children. Further, the young child is allowed to aim the strike while it is in a stationary position rather than having to throw and aim it at the same time or otherwise direct it using a launching mechanism or other more complicated or more sophisticated means. Directly holding the striker rather than operating a lever or other intermediate mechanism also more closely stimulates the feel and sense of a "bowling" game. The oscillating tail is an important added feature allowing the striker to knock over playpieces virtually after the shark has "passed by" the fish.

SUMMARY OF THE DISCLOSURE

The illustrated bowling apparatus comprises a supporting surface which is shown as a flat sheet having a bowling alley or lane represented on its upper surface. The sheet may be placed upon the floor or table or the like.

A plurality of playpieces are positioned upright on one area of the sheet generally adjacent one end of the lane. The playpieces are self-standing and adapted to be knocked over when engaged by the striker. The illustrated playpieces are representative of small fish in the particular illustrated embodiment.

The illustrated striker represents a shark figure. The illustrated striker comprises a frame or base in the form of a hollow housing or body which represents a shark figure. The body supports wheel-means and a motor-means which is operatively connected to the wheel means so as to rotate the wheel means. The illustrated motor-means is a standard self-contained unit which includes a wind-up spring that is wound or loaded by rearward movement of the wheel-means. This type of arrangement and mechanism is common in toy vehicles whereby the child user places the vehicle on a supporting surface and moves the vehicle rearwardly to rotate the wheels in a rearward direction and thereby winds the spring. When the vehicle is then released, the spring drives the wheels in the opposite or forward direction to propel the vehicle forwardly. The illustrated striker also includes transverse movement means in the form of a pivoted tail section which is caused to oscillate back and forth from side-to-side as the shark is driven forwardly. Suitable mechanical drive means are provided between the motor-means and the oscillating tail to provide the side-to-side movement.

In operation, the child-user pulls the shark rearwardly along the supporting surface at the starting end of the bowling lane to wind the spring. The child then can hold the shark stationary and aim it along the lane toward the playpieces. The child then can release the shark which causes it to move along the lane toward the playpieces to the other end. The shark body may engage and knock over one or more playpieces. As the shark passes the area of the playpieces, the oscillating tail may engage and knock over additional playpieces. The child may take a series of turns or may alternate turns with other children.

THE DRAWINGS

DETAILED DESCRIPTION OF THE DRAWINGS

Figure 1:
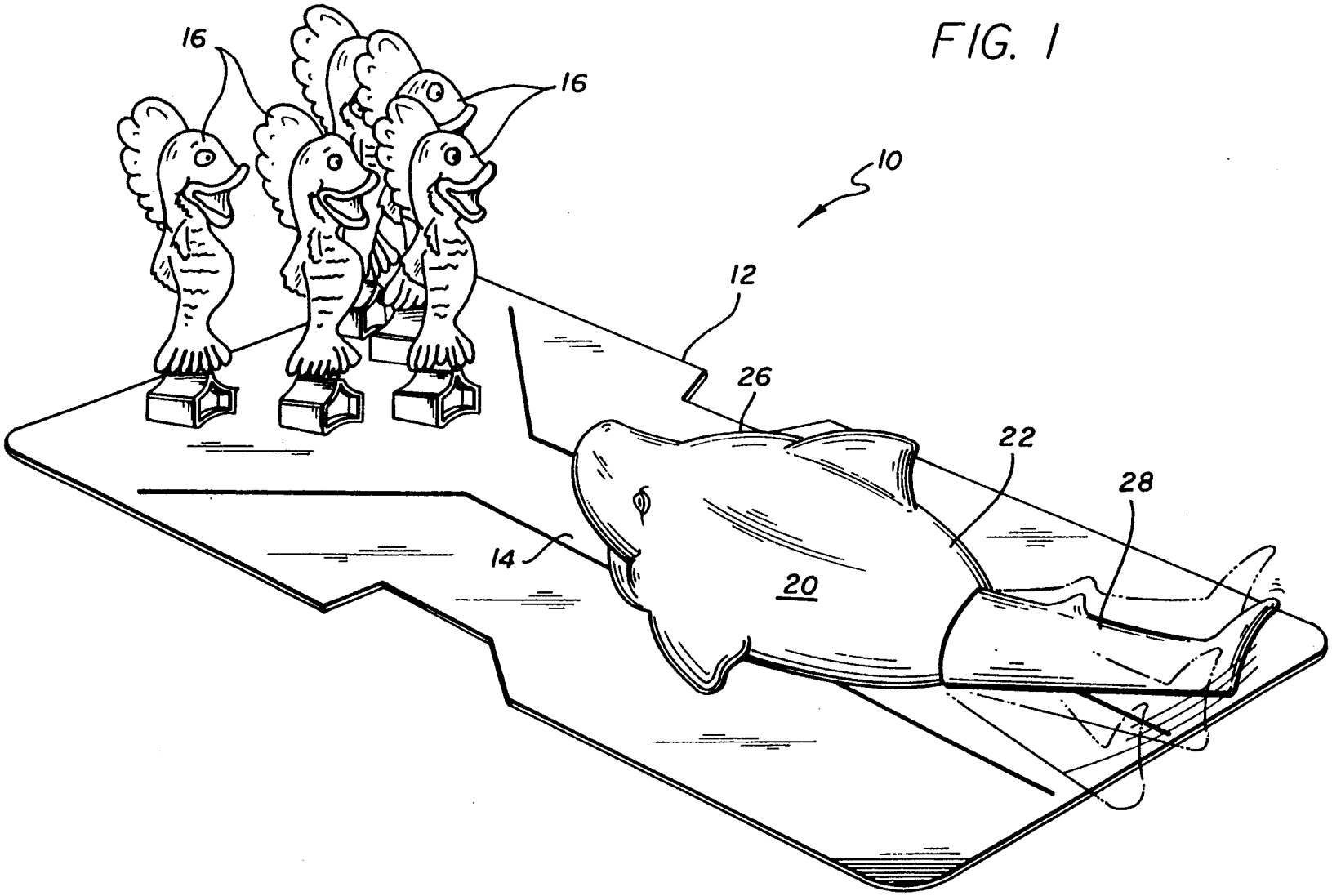
FIG. 1 is a perspective view showing the support sheet, a plurality of the playpieces and the striker.

FIG. 1 shows the various elements of the illustrated bowling game apparatus 10. A sheet 12 having a bowling alley or lane 14 on its upper surface is shown is positioned on a supporting surface such as the floor or a table. The sheet 12 may be made of any suitable material, such as plastic, paper or the like. One area is designated for placing playpieces 16 adjacent one end of the lane 12 and another area is designated for positioning the striker 20 generally adjacent the opposite end of the lane.

The illustrated playpieces 16 may be in the form of any desirable character or object. The illustrated playpieces 16 are in the form of molded plastic fish characters. The playpieces are self-standing in the upright position but are capable of being readily knocked over when they are engaged by the striker 20 or another playpiece.

The illustrated striker 20 represents a shark character. For small children this adds excitement of a predator such as a shark attacking small other creatures such as small fish in the sea. The illustrated striker 20 comprises a frame or base 22 in the form of a hollow housing or body that externally represents a shark to the child-user. There is a forward or main body section 26 and a rearward or tail body section 28 that are pivotedly connected to one another about a vertical axis X—X. The body section 26 supports and contains a self-contained standard spring-wind-up motor unit 40. The main body section 26 includes a bottom wall 30. A pair of large rear wheels 34 are rotatively supported on the opposite ends of transverse horizontal output shaft 41 of the motor unit 40. The shaft 41 is disposed adjacent the rear of the body section 26. The large rear wheels 34 extend downwardly below the bottom wall 30 through openings in that wall. Centrally of the main body section 26, adjacent its forward end, there is an adjustable small front wheel 36. Thus the shark figure is supported on a tripod made up of two large rear wheels 34 and one small front wheel 36. The front small wheel 36 is freewheeling while the two large rear wheels 34 are driven by the spring-driven motor unit 40 and serve to drive the striker 20 forwardly.

The motor unit 40 for the striker is commercially available self-contained spring-driven unit that is well-known in the art. Such a unit 40 is wound by moving the toy rearwardly with the wheels engaging a supporting surface so the wheels are rotated in a rearward direction. This winds a coil spring (not shown) within the motor unit housing 42. A gear train or other mechanism (not shown) may also be included within the motor housing 42. In the illustrated unit 40, there is mechanism (not shown) which shifts from an initial high-torque low-speed mode to a low-torque high-speed mode when the unit is released and progresses forwardly. In other words, when the striker 20 is first released by the child-user and the spring begins to drive the shark forward by rotating the wheels in a forward direction; the power may be transmitted from the wound spring through a gear train to slow down the movement and increase the power and torque. After a certain amount of forward movement, however, there is a shift in the mechanism so that the power from the spring is not geared down as much but goes more directly into faster lower-torque rotation of the wheels. The effect is for the striker 20 to start out slowly and then suddenly accelerate toward the fish playpieces 16.

Figure 2:
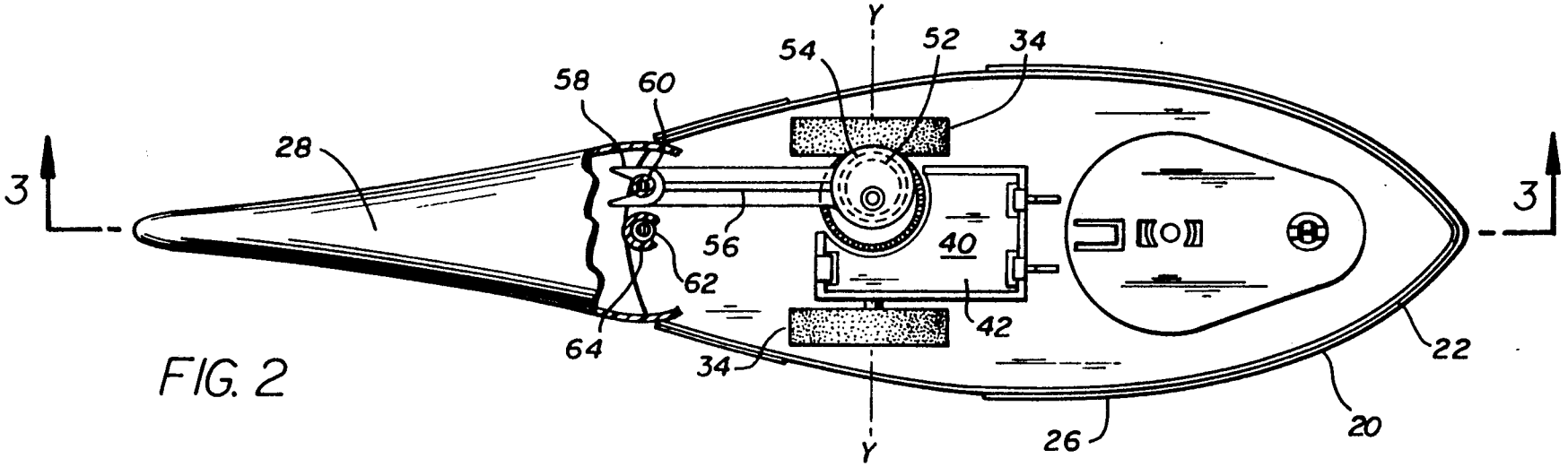
FIG. 2 is a bottom plan view of the striker.
Figures 6, 7:
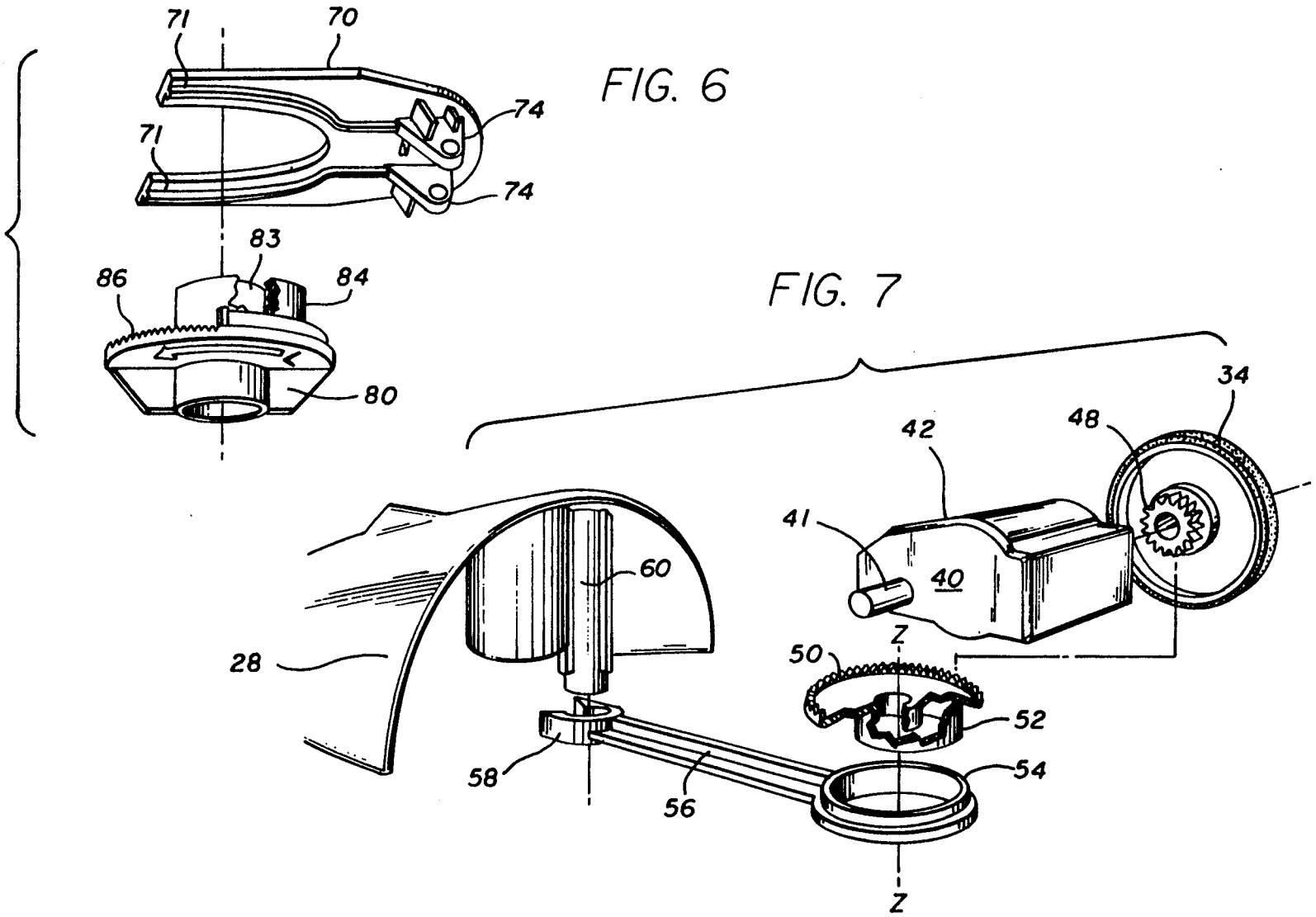
FIG. 6 is an enlarged exploded perspective view of elements of adjustable front wheel assembly.
FIG. 7 is an enlarged exploded perspective view of elements of the motor drive means and tail oscillating mechanism.

For causing the side-to-side oscillation of the pivoted tail section 28, there is an eccentric drive mechanism 46 between the motor unit 40 and the tail section. More particularly, there is a spur gear 40 (FIG. 7) formed on the inside of one of the large rear wheels 34 for common rotation about the wheel axis. The gear 48 engages an upwardly extending crown gear 50 mounted for rotation about a vertical axis Z—Z on the bottom wall 30 of the main body section 26. Also mounted for common rotation with the crown gear 50 and depending from the crown gear is an eccentrically positioned hub 53 of the generally cylindrical shape. Disposed for relative sliding rotation on the cylindrical hub 52 is a circular ring 54 fixed at the forward end of a linkage arm 56. The opposite rear end 58 of the linkage arm 56 is in the form of a yolk that is pivotedly connected to an upright pin 60 on the tail section 28 of the striker. This pin 60, as shown best in FIG. 2, is offset to one side of the central pivotal connection x—x between the tail and main body sections. This pivoted connection between the two body sections is provided by an upright pin 62 on the main body section and a sleeve 64 on the rear or tail section which receives the pin 62. As the eccentric hub 52 rotates about the central axis of the crown gear 50, the linkage arm 56 is caused to reciprocate forwardly and rearwardly to thereby impart reciprocating rotation of the rear tail section about the pivot pin 62. This provides the side-to-side oscillating movement of the rear tail section as the striker moves forwardly.

Figure 3:
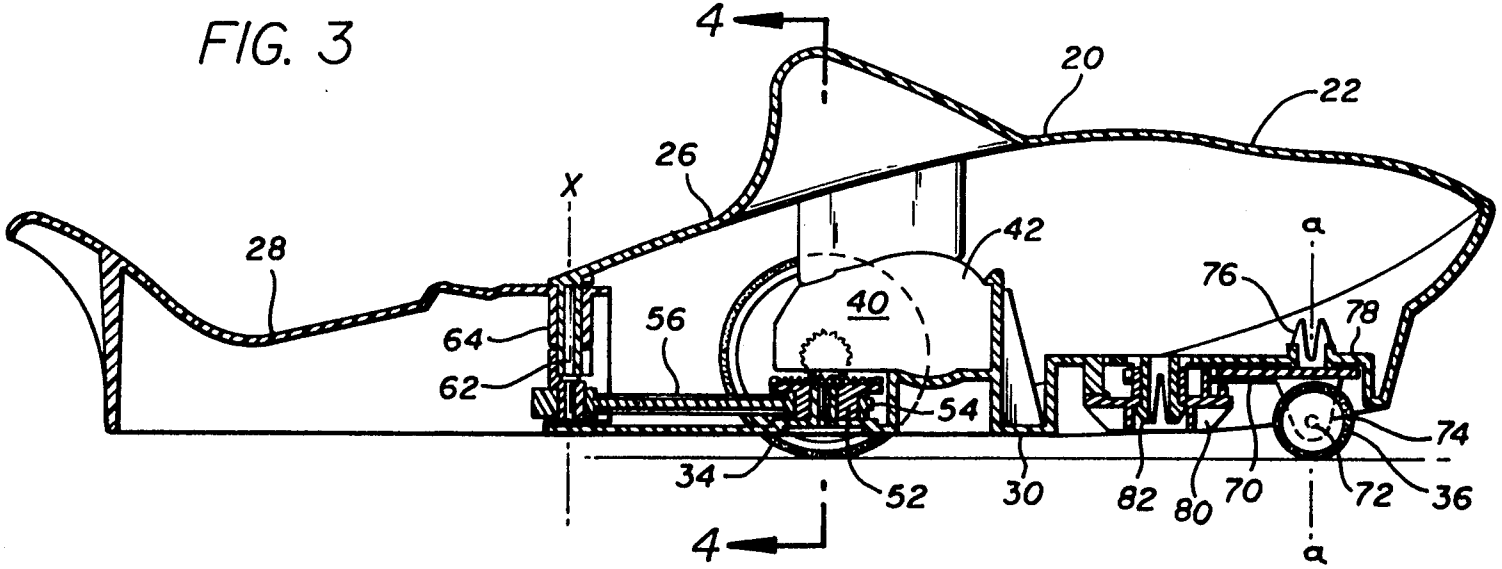
FIG. 3 is a side sectional view of the striker taken generally along line 3—3 of FIG. 2.
Figure 4:
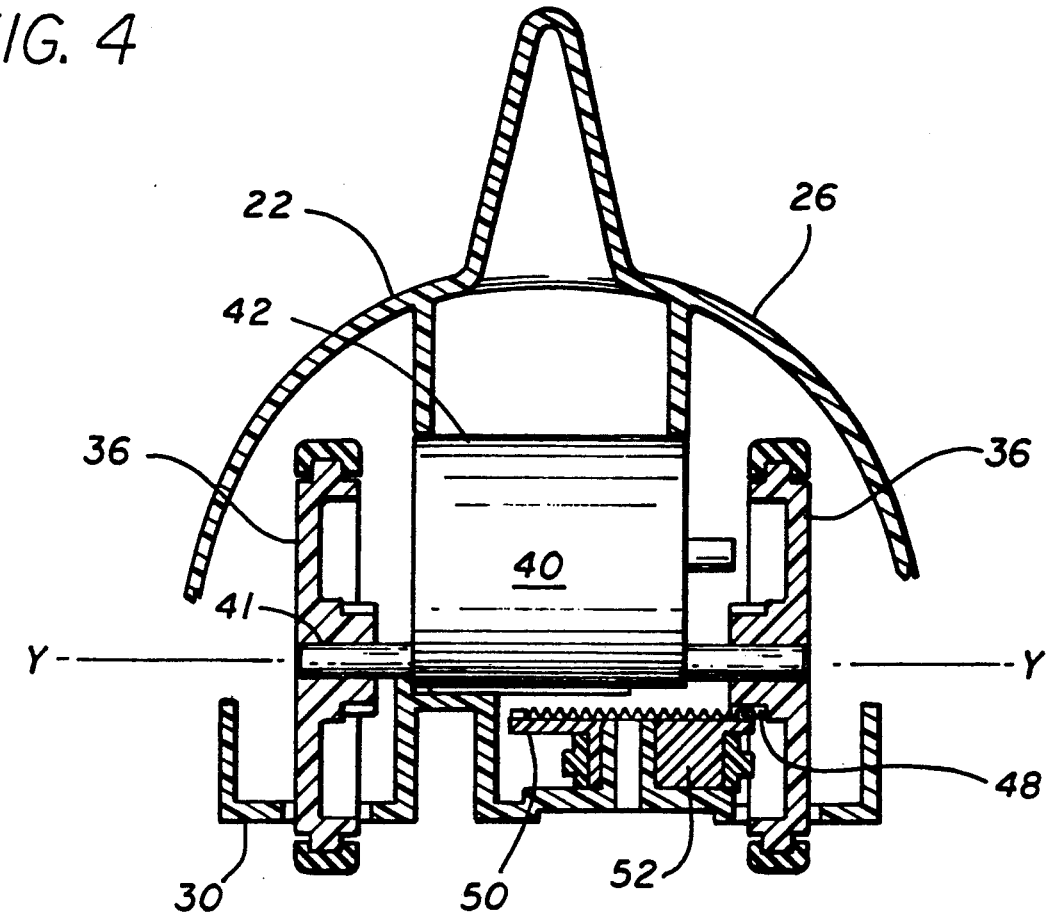
FIG. 4 is a transverse sectional view taken generally along line 4—4 of FIG. 3.
Figure 5:
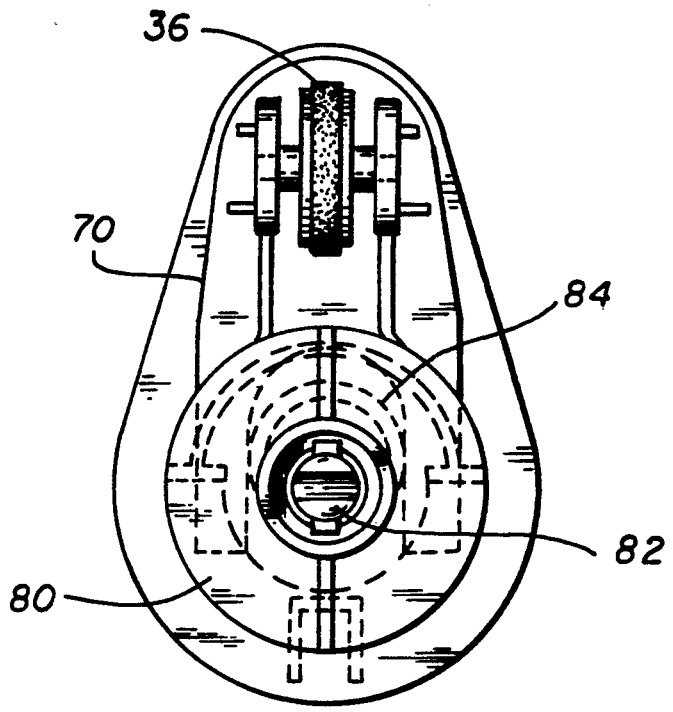
FIG. 5 is a bottom view of the adjustable front wheel assembly on the striker.

The small front central wheel 36 is rotatably mounted on a horizontally extending yoke plate 70 to allow selective adjustment of the direction of the front wheel. The plate 70 is generally U-shaped with a pair of rearwardly extending spaced legs 71. The plate 70 is mounted adjacent its forward end for rotation about a vertical axis a—a in a recessed area at the front of the bottom wall 30. More particularly, the front wheel 36 is fixed to a horizontal shaft that is pivotedly supported between a pair of spaced ear portions 74 that depend from the underside of the horizontal yoke plate 70. The yoke plate 70 has an upwardly extending split pivot pin 76 (FIG. 3) that is rotatedly received in a mating sleeve 78 in the bottom wall 30 of the main body section. The rotational alignment of the yoke plate 70 which determines the precise direction of the front wheel 36 may be adjusted by the child-user through a control mechanism. This mechanism includes a manually turnable knob 80 this is rotatably supported on a split shaft pin 82 that depends from the underside of the bottom wall 30 and is received in a central sleeve 83 of the knob. The rotatable knob 80 includes a cam portion 84 that is disposed between the legs 71 of the yoke plate 70. The cam portion 84 is eccentric relative to the axis of rotation of the knob 80 so that as the knob is rotated one way or the other, the cam portion engages one or the other of the legs 71 and rotates the yoke plate in that direction. This serves to adjust the alignment of the forward wheel 36. The knob 80 may be rotated one way or the other to adjust the front wheel to compensate for the tendency of a particular striker to veer off to the right or left from the direction in which it is aimed. The control mechanism may include means in the form of a serrated ratchet edge 86 on the knob 80 that engages a projection (not shown) on the underside of the yoke plate 70 to afford incremental adjustment of the knob and front wheel.

The shark body may be made of any suitable material such as molded plastic, as may the various other component parts.

In play with the bowling apparatus 10, the playpieces 16 are stood up in their area on the sheet 12 at one end of the bowling lane 14. The child takes the striker shark 20 and pulls it rearwardly so that the large wheels 34 engaged the supporting surface and are rotated rearwardly so as to wind the spring of the motor unit 40. The child may then hold the striker 20 in this stationary condition and slowly and carefully aim the direction of the striker to hit the playpieces. When the child is through aiming the striker, he or she can release the striker and thereby cause it to advance forwardly toward the playpieces. As noted above, the striker first moves slowly and then switches into high speed. The striker may engage one or more of the molded fish playpieces and thereby knock them over. As noted above, the shark striker not only knocks over playpieces by striking them with its jaws (front end), but also may knock over playpieces by virtue of the oscillating back and forth movement of the tail section 28. The score of the child for that attempt is then noted as on a score pad.

The child may take a series of turns or several children may alternate taking turns and keep their respective scores in a competitive game situation.

Various changes may be made in this specific illustrated structure without departing from the spirit and scope of the invention as set forth in the following claims. By way of example only, the spring motor could be hand wound and have a release switch to cause a forward movement at the desired time. Similarly, other or additional or varied mechanical movements could be provided as the shark advances toward the fish.

What is claimed is:

1. A bowling game apparatus comprising:

1) at least one playpiece for standing upright on a supporting surface, and 2) a self-powered striker which is movable forwardly along the supporting surface toward the playpieces, the gam objective being for the striker to engage and knock over the playpieces, the striker having motor means for causing the forward movement of the striker toward the playpieces, the striker also having a main portion with opposed sides and a transversely movable portion connected to the main portion, the movable portion being transversely movable relative to the striker main portion to a position beyond at least one of said sides while the strike moves forwardly, for engaging the playpieces as the striker moves past the playpieces.

2. The game apparatus of claim 1 wherein said transversely movable portion is pivotally mounted for oscillating side-to-side movement about a generally upright axis.

3. The game apparatus of claim 2 wherein said striker represents a fish and the transversely movable portion represents the tail portion of the fish.

4. The game apparatus of claim 1 wherein there are a plurality of the playpieces.

5. The gam apparatus of claim 1 wherein the motor means drives the transversely movable portion so as to move that portion transversely while concurrently moving the strike forwardly.

6. The game apparatus of claim 1 wherein the movable portion moves to positions outwardly of both of said opposite sides of the striker main portion.

* * * * *